US011492953B1

(12) United States Patent
Chen et al.

(10) Patent No.: US 11,492,953 B1
(45) Date of Patent: Nov. 8, 2022

(54) HEAT EXCHANGER WITH COOLANT MANIFOLD

(71) Applicant: Caterpillar Inc., Peoria, IL (US)

(72) Inventors: Allen Y. Chen, Dunlap, IL (US); Jason L. Van Farowe, Brimfield, IL (US); Scott R. Schuricht, Princeville, IL (US); Kyle V Zeitler, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/522,438

(22) Filed: Nov. 9, 2021

(51) Int. Cl.
*F01P 3/00* (2006.01)
*F01P 3/18* (2006.01)
*F01P 3/12* (2006.01)

(52) U.S. Cl.
CPC ..... *F01P 3/18* (2013.01); *F01P 3/12* (2013.01); *F01P 2060/04* (2013.01); *F01P 2060/08* (2013.01); *F01P 2060/16* (2013.01); *F01P 2070/52* (2013.01)

(58) Field of Classification Search
CPC ..... F01P 2060/16; F01P 3/00; F28D 9/005; F28D 2021/0089; F28D 9/0037; F28D 9/0056; F28D 9/0093; F28D 2021/004; F02B 29/0462; F28F 27/02; F28F 9/001; F28F 9/002; F28F 9/005; F28F 9/24; F28F 2280/00; F28F 2280/06
See application file for complete search history.

(56) References Cited

U.S. PATENT DOCUMENTS

| | | | | |
|---|---|---|---|---|
| 5,964,280 | A | 10/1999 | Wehrmann et al. | |
| 6,591,896 | B1 | 7/2003 | Hansen | |
| 7,111,669 | B2 * | 9/2006 | Hoglinger | F28D 1/0443 165/174 |
| 7,669,437 | B2 | 3/2010 | Sanada | |
| 8,752,522 | B1 | 6/2014 | Cohen | |
| 9,903,674 | B2 | 2/2018 | Kim et al. | |
| 9,957,879 | B2 | 5/2018 | Tokozakura et al. | |
| 10,989,481 | B2 | 4/2021 | Crawford et al. | |
| 2016/0153408 | A1 * | 6/2016 | Amaral | F01M 5/002 123/196 AB |
| 2017/0037770 | A1 * | 2/2017 | Cook | F28F 9/0253 |
| 2018/0274406 | A1 * | 9/2018 | Dries | F01M 5/007 |
| 2020/0318919 | A1 * | 10/2020 | Tonellato | F28F 3/08 |

FOREIGN PATENT DOCUMENTS

| | | | | |
|---|---|---|---|---|
| ES | 2661407 T3 * | 3/2018 | | F01M 5/002 |
| FR | 3058786 A1 * | 5/2018 | | B60K 11/02 |
| WO | WO-2015000048 A1 * | 1/2015 | | F01M 5/002 |

* cited by examiner

*Primary Examiner* — George C Jin
*Assistant Examiner* — Teuta B Holbrook
(74) *Attorney, Agent, or Firm* — Schwegman Lundberg & Woessner, P.A.

(57) ABSTRACT

Apparatuses and methods are disclosed including heat exchanger for an internal combustion engine. The heat exchanger can include a main body, a manifold and one or more outlet ports. The main body can have an inlet and an outlet to receive/pass a coolant on a first side thereof. The main body can have a fluid inlet and fluid outlet configured to receive a fluid. The main body can pass the fluid in a heat exchange relationship with the coolant. The manifold can be coupled to the main body on a second side. The manifold can be in fluid communication with a main coolant outlet passage to receive a portion of the coolant from the main body. The one or more outlet ports can be fluidly connected to the manifold and passing the portion of the coolant to one or more engine auxiliary systems.

20 Claims, 6 Drawing Sheets

HEAT EXCHANGER WITH COOLANT MANIFOLD

TECHNICAL FIELD

The present disclosure relates to internal combustion engines. More particularly, the present disclosure relates to heat exchangers such as internal combustion engine mounted fluid coolers having a manifold.

BACKGROUND

Machinery, for example, military, agricultural, industrial, construction or other heavy machinery can be propelled by one or more internal combustion engine(s). Internal combustion engines combust a mixture of air and fuel in cylinders and thereby produce drive torque and power.

Many times, internal combustion engine coolant is used to cool down other parts of the vehicle or for other applications since it is readily available and the medium is relatively cool and efficient at heat rejection.

Internal combustion engine mounted fluid coolers typically do not have manifolds but rather utilize direct single connection ports for coolant as disclosed in U.S. Pat. Nos. 9,903,675B2 and 10,989,481B2 or utilize multiple heat exchanger units as disclosed in U.S. Pat. No. 8,752,522B1.

SUMMARY

In an example according to this disclosure, a heat exchanger for an internal combustion engine is disclosed. The heat exchanger can include a main body, a manifold and one or more outlet ports. The main body can have an inlet to receive a coolant from the internal combustion engine on a first side thereof and pass the coolant therethrough including via a main coolant outlet passage to an outlet for the coolant to pass back to the internal combustion engine on the first side. The main body can have a fluid inlet to receive a fluid, can pass the fluid in a heat exchange relationship with the coolant and can output the fluid from the main body at a fluid outlet. The manifold can be coupled to the main body on a second side. The manifold can be in fluid communication with the main coolant outlet passage to receive a portion of the coolant from the main body. The one or more outlet ports can be fluidly connected to the manifold and passing the portion of the coolant to one or more engine auxiliary systems.

In another example according to this disclosure, an internal combustion engine for a vehicle is disclosed. The internal combustion engine can include an internal combustion engine block, one or more auxiliary systems of the internal combustion engine, and a heat exchanger. The heat exchanger can be coupled to the internal combustion engine block. The heat exchanger can include a main body, a manifold and one or more ports. The main body can have an inlet to receive a coolant on a first side thereof and an outlet for the coolant to pass from the main body on the first side. The main body can have a fluid inlet configured to receive fluid at a fluid inlet, can pass the fluid in a heat exchange relationship with the coolant and can output the fluid from the main body at a fluid outlet. The manifold can be in fluid communication with the main body on a second side. The manifold can receive a portion of the coolant from the main body The one or more outlet ports can be fluidly connected to the manifold and can be fluidly connected to the one or more auxiliary systems of the internal combustion engine to pass the portion of the coolant to the one or more auxiliary systems of the internal combustion engine.

In yet another example according to this disclosure, a method of providing a coolant to one or more auxiliary systems of an internal combustion engine is disclosed. The method includes directing a fluid to a heat exchanger, directing the coolant to the heat exchanger, passing the coolant and the fluid through the heat exchanger to provide for heat exchange between the fluid and the coolant, passing a first portion of the coolant to a manifold in fluid communication with the heat exchanger, passing the first portion of the coolant from the manifold through one or more outlet ports to the one or more auxiliary systems of the internal combustion engine, and passing a remainder of the coolant and the fluid from the heat exchanger.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Examples according to this disclosure are directed to internal combustion engines, auxiliary systems thereof and to methods for providing a coolant to one or more auxiliary systems of an internal combustion engine. Examples of the present disclosure are now described with reference to the accompanying drawings. The following description is merely exemplary in nature and is not intended to limit the present disclosure, application, or use. Examples described set forth specific components, devices, and methods, to provide an understanding of embodiments of the present disclosure. It will be apparent to those skilled in the art that specific details need not be employed and that examples may be embodied in many different forms. Thus, the examples provided should not be construed to limit the scope of the claims.

Figure 1:
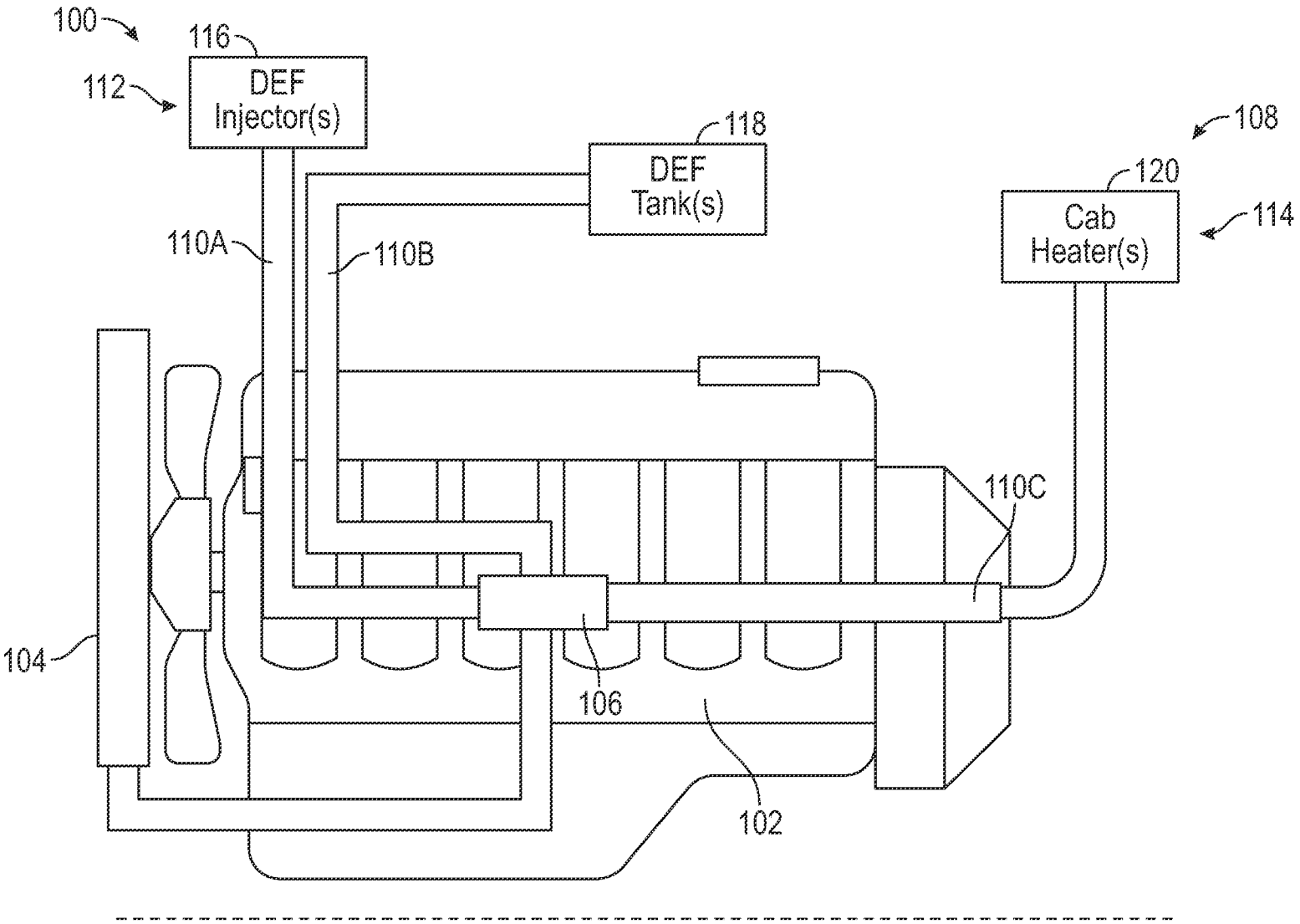
FIG. 1 is a schematic illustration depicting an example internal combustion engine including two or more engine auxiliary systems in accordance with an example of this disclosure.

FIG. 1 depicts an example schematic illustration of an internal combustion engine 100 in accordance with this disclosure. The internal combustion engine 100 can be used for power generation such as for the propulsion of vehicles or other machinery. The internal combustion engine 100 can include various power generation platforms, including, for example, an internal combustion engine, whether gasoline, natural gas, diesel or any other desired fuel. It is understood that the present disclosure can apply to any number of piston-cylinder arrangements and a variety of internal combustion engine configurations including, but not limited to, V-internal combustion engines, inline internal combustion engines, and horizontally opposed internal combustion engines, as well as overhead cam and cam-in-block configurations.

In some applications, the internal combustion engines disclosed here are contemplated for use in gas compression. Thus, the internal combustion engines can be used in stationary applications in some examples. In other applications the internal combustion engines disclosed can be used with vehicles and machinery that include those related to various industries, including, as examples, construction, military, agriculture, forestry, transportation, material handling, waste management, etc.

The internal combustion engine 100 can include an engine block 102, a radiator 104, a heat exchanger 106 and one or more engine auxiliary systems 108. The engine block 102 can define various portions of the engine including the crankcase, the combustion cylinders and other components known in the art. These components are not specifically illustrated in FIG. 1. A fan 105 can be positioned between the radiator 104 and the engine block 102 to provide cooling for the engine 100. The radiator 104 can be spaced from the engine block 102 by the fan 105. The radiator 104 can be part of the engine's cooling system. The radiator 104 can function to monitor and regulate a temperature of the engine 100 and prevent the engine 100 from overheating as known in the art. The heat exchanger 106 can be fluidly coupled with the radiator 104. Thus, the two components can be in fluid communication as further discussed herein. The heat exchanger 106 can be mounted to the engine block 102.

The one or more engine auxiliary systems 108 can fluidly couple with the heat exchanger 106 via lines 110A, 110B and 110C. The lines 110A, 110B, and 110C can be in fluid communication with the heat exchanger 106 to provide a coolant (e.g., water, refrigerant, etc.) from the heat exchanger 106 to the one or more engine auxiliary systems 108.

The one or more engine auxiliary systems 108 can include, but are not limited to, a diesel exhaust fluid (DEF) system 112 and a cab heat system 114, for example. The DEF system 112 can include DEF injector(s) 116 and DEF tank(s) 118. The cab heat system 114 can include cab heater(s) 120.

The coolant can be provided from the heat exchanger 106 via line 110C to the cab heater(s) 120 to cool components thereof. Cab heater(s) 120 can provide warmth to the operator cab during operation of the internal combustion engine 100.

Coolant can be provided from the heat exchanger 106 to the DEF system 112. The DEF system 112 can be used in association with an engine emission control systems as known in the art. As an example, the DEF system 112 can be used for abating certain diesel engine exhaust constituents as part of an exhaust after-treatment system that utilizes Selective Catalytic Reduction (SCR) of nitrogen oxides. In a typical SCR system, DEF, which may include urea or a urea-based water solution or another solution, is mixed with engine exhaust gas before being provided to an appropriate catalyst. In some applications, the DEF is injected directly into an exhaust passage through the DEF injector(s) 116. In the case of urea, the injected DEF mixes with exhaust gas and breaks down to provide ammonia ($NH_3$) in the exhaust stream. The ammonia then reacts with nitrogen oxides (NOx) in the exhaust at a catalyst to provide nitrogen gas ($N_2$) and water.

SCR systems require the presence of some form of DEF such that the engine can be continuously supplied during operation. Various DEF delivery systems are known and used in engine applications. One such DEF system 112 is illustrated, and has the DEF tank(s) 118 in addition to the DEF injector(s) 116. The DEF tank(s) 118 and the DEF injector(s) 116 can draw coolant as needed from the heat exchanger 106. The DEF tank(s) 118 can be installed onto a vehicle for containing the DEF, which can be drawn from the DEF tanks(s) 118 and delivered in metered amounts to the engine exhaust system. The DEF tank(s) 118 can have a finite urea capacity such that periodic replenishment of the DEF within the DEF tank(s) 118 is required.

The heat exchanger 106 can receive the coolant such as from the engine 100 or another source. The heat exchanger 106 can be a liquid-to-liquid plate heat exchanger according to some examples. Engine transmission fluid (e.g., oil, glycol, water-glycol, etc.), hydraulic fluid or another fluid can be passed in a heat exchange relationship with the coolant within the heat exchanger 106.

Figure 2:
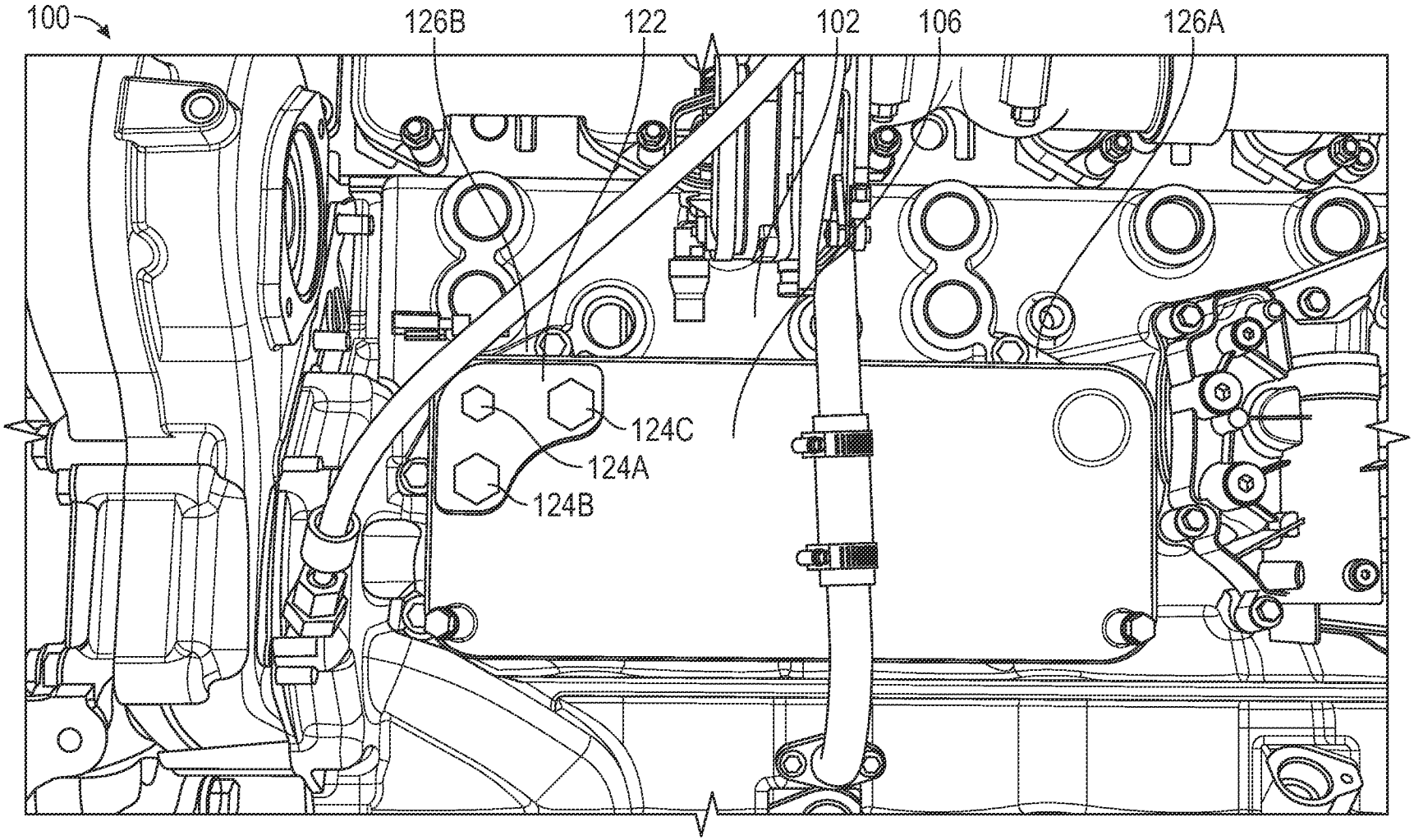
FIG. 2 is a plan view of a portion of the internal combustion engine of FIG. 1 including a heat exchanger and a manifold in accordance with an example of this disclosure.

FIG. 2 shows a portion of the engine 100 according to an example including the engine block 102 and the heat exchanger 106. As shown in FIG. 2, once the engine 100 is fully dressed in auxiliary components, access to coolant ports (such as on the engine block 102) is restrictive, hard-to-reach, or sometimes challenging to access. For engines that have on-engine-mounted liquid-to-liquid coolers like the heat exchanger 106, it may be challenging to reach coolant ports without the use of unique tools. FIG. 2 illustrates pipes, lines and other auxiliary components that make access to the engine block 102 and parts of the heat exchanger 106 difficult. Thus, the present heat exchanger 106 includes a manifold 122 coupled to an accessible portion thereof with a plurality of ports 124A, 124B and 124C therein. Heat exchanger 106 is mounted to the engine block 102 by a plurality of mounting flanges 126A and 126B.

Figure 3A:
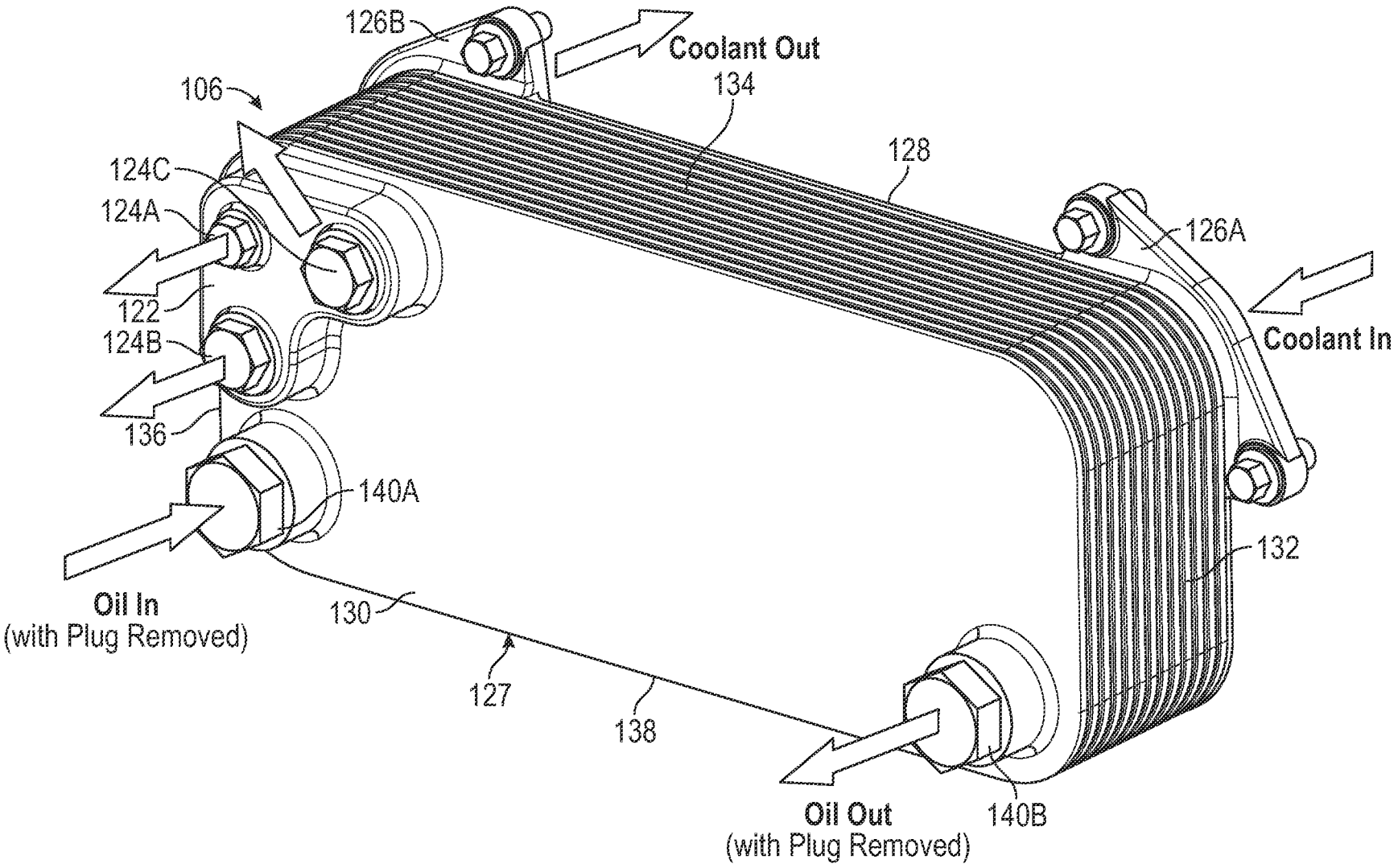
FIG. 3A is a perspective view of the heat exchanger and the manifold in accordance with an example of this disclosure.

FIG. 3A shows a diagram of the heat exchanger 106 in isolation showing the inflow and outflow of fluids such as coolant and fluid illustrated with arrows. In addition to the manifold 122, the plurality of ports 124A, 124B and 124C and plurality of mounting flanges 126A and 126B, the heat exchanger 106 can include a main body 127, a mounting surface 128 (also shown in FIG. 3B in more detail), an access surface 130, a third side 132, a fourth side 134, a fifth side 136, a sixth side 138, and ports 140A and 140B.

As depicted in FIG. 3A, the mounting surface 128 and the access surface 130 face opposite directions, the third side 132 and the fifth side 136 face opposite directions, and the fourth side 134 and the sixth side face opposite directions.

The heat exchanger 106 can be generally rectangular and can comprise a plate style liquid-to-liquid heat exchanger with two or more separated liquids flowing in a heat exchange relationship where heat exchange occurs via conduction through a metal wall or plate as known in the art. The mounting surface 128 can interface with the mounting block 102 (FIG. 2) when the heat exchanger 106 is mounted thereto. The access surface 130 can comprise a first major face of the heat exchanger 106 and can be exposed or partially exposed for access when the heat exchanger 106 is mounted in position on the radiator. The access surface 130 can face an opposite direction from the mounting surface 128. The access surface 130 can have the manifold 122 coupled thereto as well as can include the ports 140A and 140B. The ports 140A and 140B can be adjacent one or more edges of the access surface 130. Similarly, the manifold 122 and the plurality of ports 124A, 124B and 124C can be adjacent one or more edges of the access surface 130.

The third side 132, the fourth side, the fifth side 136 and the sixth side 138 can connect between the mounting surface 128 and the access surface 130. The six sides together form the main body 127. The port 140A can be positioned adjacent the fifth side 136 and the sixth side 138. The port 140B can be positioned adjacent the third side 132 and sixth side 138. The manifold 122 and the plurality of ports 124A, 124B and 124C can be adjacent the fourth side 134 and fifth side 136. The mounting flanges 126A and 126B can be positioned to extend from the mounting surface 128. The mounting flange 126A can be adjacent or couple with the third side 132 and the fourth side 134. The mounting flange 126B can be adjacent or couple with the fourth side 134 and the fifth side 136.

However, the position of the ports 140A and 140B, the manifold 122 and the mounting flanges 126A and 126B is exemplary and these can be on different sides or in different positions according to further embodiments. Similarly, the shape of the heat exchanger 106 can differ according to different embodiments. The port 140A can be an oil (or other fluid) inlet and the port 140B can be the oil (or other fluid) outlet as shown in FIG. 3A. However, reverse flow of fluids through the heat exchanger 106 can be possible such that inlet ports can be outlet ports according to some embodiments. The ports 140A, 140B, 124A, 124B and 124C are shown with plugs in according to FIG. 3A and other FIGURES. However, it is understood during engine operation any number of these plugs would be removed and the ports 140A, 140B, 124A, 124B and 124C would be coupled to fluid communication lines using known coupling mechanisms.

The manifold 122 can be a fabricated component of the heat exchanger 106 formed during initial fabrication of the heat exchanger 106 or can be retrofit into an existing heat exchanger already mounted on a deployed engine. The manifold 122 can be brazed, welded or otherwise attached to the heat exchanger 106. Although shown as extending beyond the access surface 130, according to some embodiments the manifold 122 can be recessed within part of the heat exchanger 106 or can be formed flush with the access surface 130. The plurality of ports 124A, 124B and 124C can have different shapes, numbers and sizes according to desired coolant supply needs. As depicted in FIG. 3A, the port 124A has a different size than the ports 124B and 124C. The number of ports can also vary depending on the embodiment and auxiliary coolant needs. In other words the manifold 122 can include one or more ports, as desired.

Figure 3B:
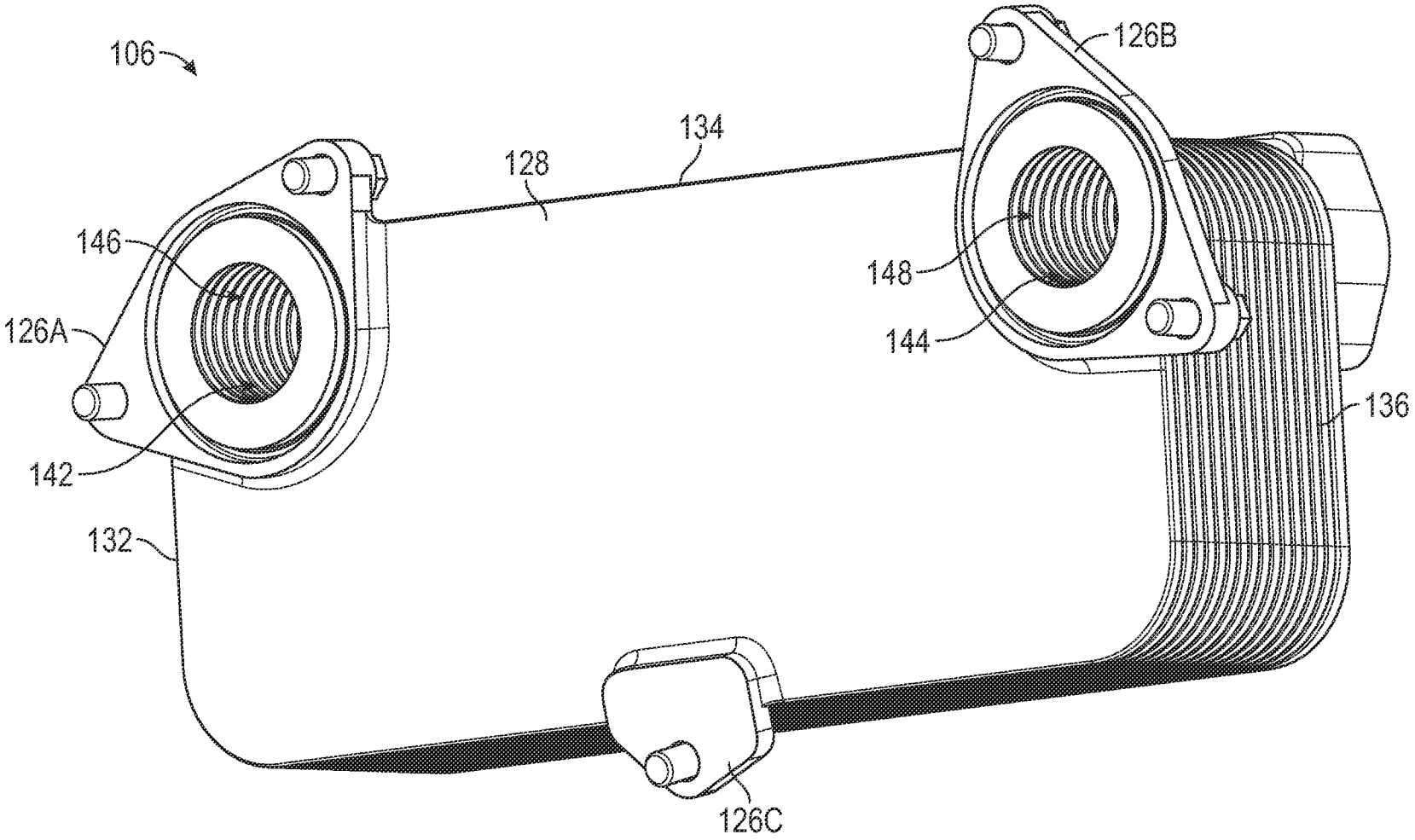
FIG. 3B is a second perspective view of the heat exchanger of FIG. 3A showing a second side of the device in accordance with an example of this disclosure.

FIG. 3B shows the mounting surface 128 and mounting flanges 126A and 126B. As shown in FIG. 3B, the mounting flange 126A can include an aperture that defines a coolant inlet port 142 and the mounting flange 126B can include an aperture that defines a coolant outlet port 144. However, as discussed above reverse flow of coolant could be possible according to some examples such that the inlet would become the outlet an vice versa. The coolant inlet port 142 can be adjacent the third side 132 and the fourth side 134. The coolant outlet port 144 can be adjacent the fourth side 134 and the fifth side 136. A third mounting flange 126C can be utilized according to some embodiments.

FIG. 3B additionally shows portions of a main coolant inlet passage 146 and a main coolant outlet passage 148. The main coolant inlet passage 146 fluidly communicates with the coolant inlet port 142. The main coolant outlet passage 148 is concentric with and fluidly communicates with the coolant outlet port 144. The main coolant inlet passage 146 and the main coolant outlet passage 148 extend from the mounting surface 128 toward and adjacent the access surface 130 of the heat exchanger 106.

As the apertures of the mounting flanges 126A and 126B can define the coolant inlet port 142 and the coolant outlet port 144, respectively, the mounting flanges 126A and 126B can include recesses or other sealing features so as to receive gaskets or other features to seal the ports 142 and 144. The mounting flanges 126A and 126B can also receive fasteners (e.g., bolt, nuts, etc.) to mount to the radiator or other engine component.

Figure 4:
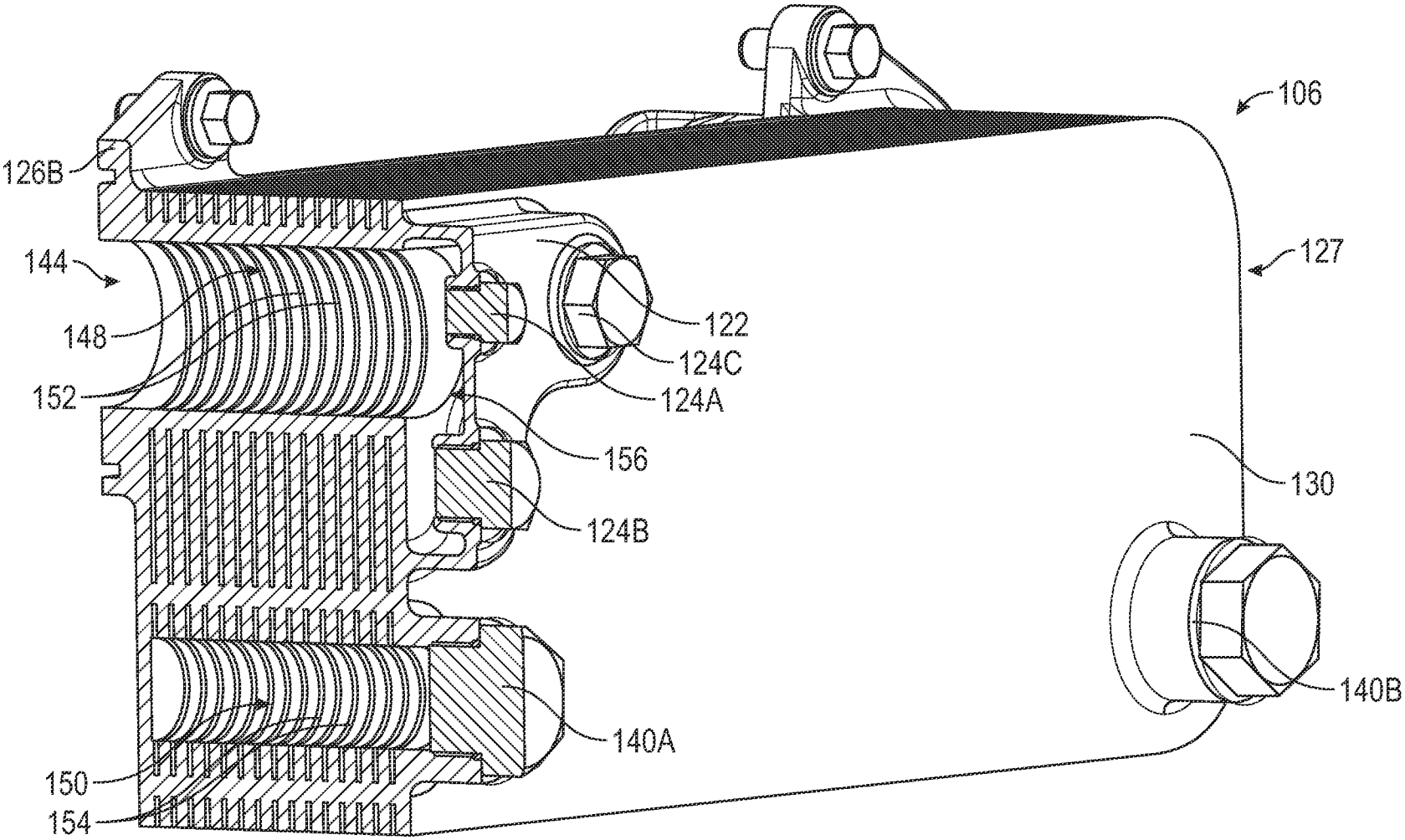
FIG. 4 is a cross-sectional view through portions of the heat exchanger and the manifold according to another example of this disclosure.

FIG. 4 shows a cross-sectional view of the main body 127 of the heat exchanger 106 through the mounting flange 126B, the coolant outlet port 144, the main coolant outlet passage 148, the manifold 122 and two of the plurality of ports 124A and 124B. The cross-section additionally reveals a fluid inlet passage 150 and the port 140A (fluid inlet port) of the heat exchanger 106. This fluid inlet passage 150 and the port 140A allow a second fluid (e.g., transmission, hydraulic or other fluid) to enter the heat exchanger 106 and pass in a heat exchange relationship with the coolant passing through the heat exchanger 106 and exiting the heat exchanger 106 along the main coolant outlet passage 148 and the coolant outlet port 144.

FIG. 4 shows a first plurality of spaced apart passages 152 that fluidly communicate with the main coolant outlet passage 148. The first plurality of spaced apart passages 152 can be arranged generally transverse to the main coolant outlet passage 148. The first plurality of spaced apart passages 152 can extend from the main coolant outlet passage 148 toward and to a main coolant inlet passage (not shown) that fluidly communicates with the coolant inlet port 142 (FIG. 3B). The first plurality of spaced apart passages 152 allow coolant to pass through the heat exchanger from the main coolant inlet passage to the main coolant outlet passage 148.

Similarly, the main fluid inlet passage 150 can fluidly communicate with a second plurality of spaced apart passages 154 can be arranged generally transverse to the main fluid inlet passage 150. The second plurality of spaced apart passages 154 can extend from the main fluid inlet passage 150 toward and to a main outlet passage (not shown) that fluidly communicates with the fluid outlet port 140B. The second plurality of spaced apart passages 154 allow a fluid (transmission, hydraulic, etc.) to pass through the heat exchanger from the main fluid inlet passage 150 to the a main outlet passage (not shown) that fluidly communicates with the fluid outlet port 140B.

The first plurality of spaced apart passages 152 can allow coolant to pass through the main body 127 in a first direction. The second plurality of spaced apart passages 154 can allow fluid to pass through the main body 127 in a second direction opposite the first direction. The plurality of spaced apart passages 152 and the fluid therein can be in a heat exchange relationship with the second plurality of spaced apart passages 154 as these two fluids are separated only by thin metal plates/walls as known in the art. Heat can pass through the thin metal plates/walls via conduction from the fluid at a higher temperature to the fluid at a lower temperature.

Figure 5:
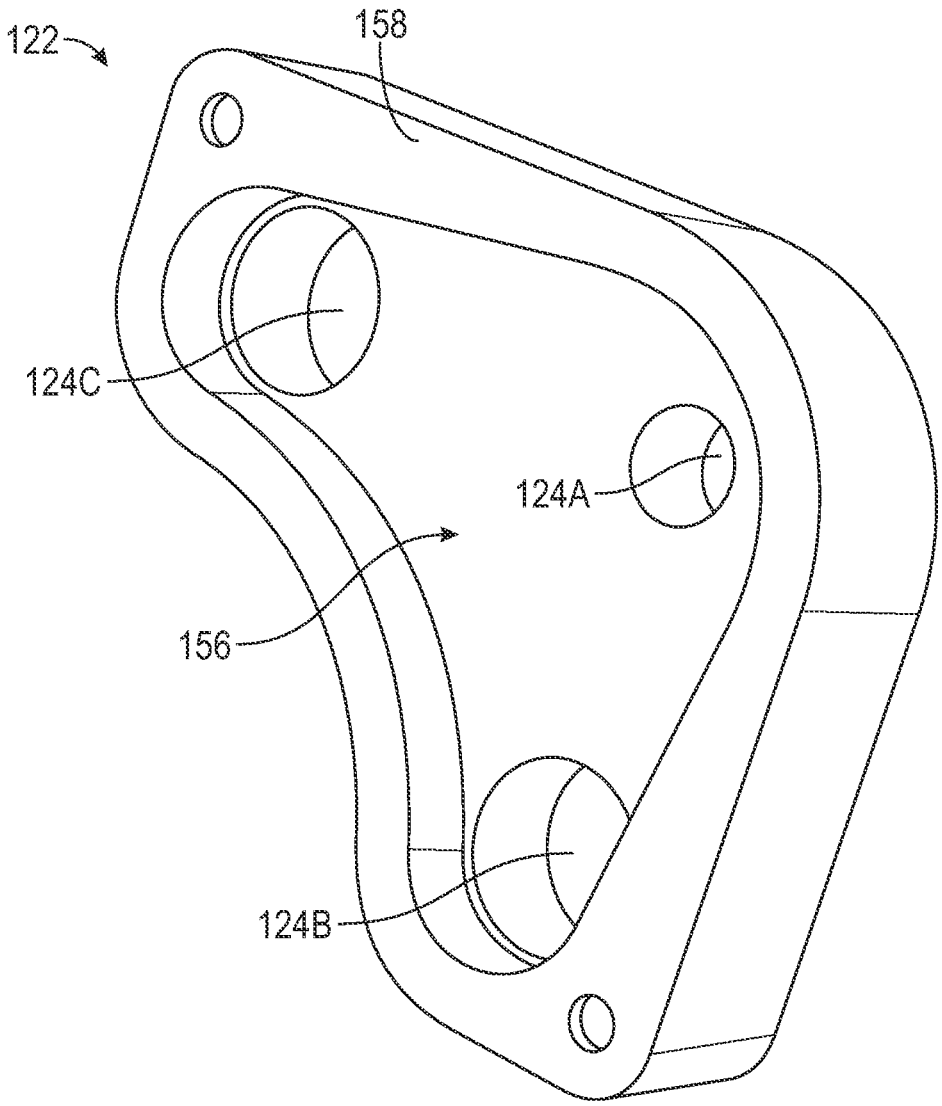
FIG. 5 is a perspective view of a second side of the manifold of FIGS. 2-4 in accordance with an example of this disclosure.

The manifold 122 can be proud of the access surface 130 as shown in FIG. 4. The manifold 122 can include a reservoir or recess 156 that fluidly communicates with the main coolant outlet passage 148 at an outer end thereof. The recess 156 can receive a part of the coolant of the main coolant outlet passage 148 from the outer end thereof. Recess 156 can communicate the coolant fluidly with the plurality of ports 124A, 124B and 124C. FIG. 5 shows the manifold 122 with the recess 156 and the plurality of ports 124A, 124B and 124C in isolation. Surface 158 can be an underside or mounting surface that is brazed, fastened, welded or otherwise coupled to the heat exchanger 106.

INDUSTRIAL APPLICABILITY

In operation, the internal combustion engine 100 can be configured to combust fuel to generate power. Auxiliary systems such as the DEF system 112 and the cab heat system 114 can be powered by the engine 100 and can utilize coolant provided by engine components. A heat exchanger 106 can be utilized for liquid-to-liquid heat exchange between coolant and other fluid(s) such as transmission or hydraulic fluid. However, with the engine fully dressed, fluid lines, auxiliary components, positioning of the heat exchanger within the engine compartment and other features may interfere with access to the heat exchanger 106. The present disclosure contemplates the use of a manifold 122 that can be positioned in an accessible location on the heat exchanger 106. The manifold 122 can be in fluid communication to provide coolant with one or more of the auxiliary systems 108 and components (e.g., DEF injector(s) 116, DEF tank(s) 118 and cab heater(s) 120) via the ports 124A, 124B and 124C and the lines 110A, 110B and 110C. The ports 124A, 124B and 124C can all be located on the manifold 122 and can be more readily accessible to personnel for connection with the fluid lines 110A, 110B and 110C.

In operation, coolant can be provided to one or more auxiliary systems 108 of the internal combustion engine 100 via the heat exchanger 106. A fluid and a coolant can be directed to the heat exchanger 106. The heat exchanger 106 can be configured to pass the coolant in close proximity to the fluid to provide for heat exchange between the fluid and the coolant. A first portion of the coolant can pass to the manifold 122 in fluid communication with the heat exchanger 106. The first portion of the coolant can pass from the manifold through one or more outlet ports 124A, 124B and/or 124C to the one or more auxiliary systems 108 of the internal combustion engine 100. A remainder of the coolant and the fluid can pass from the heat exchanger 106.

The coolant can be used by the one or more auxiliary systems 108 such as to provide the coolant to the components thereof (e.g., DEF injector(s) 116, DEF tank(s) 118 and cab heater(s) 120). The coolant can be used for Selective Catalytic Reduction (SCR) of nitrogen oxides and to heat the cab of a vehicle, for example, with the one or more auxiliary systems 108.

The above detailed description is intended to be illustrative, and not restrictive. The scope of the disclosure should, therefore, be determined with references to the appended claims, along with the full scope of equivalents to which such claims are entitled.

What is claimed is:

1. A heat exchanger for an internal combustion engine, the heat exchanger comprising:

a main body having an inlet to receive a coolant from the internal combustion engine on a first side thereof and pass the coolant therethrough including via a main coolant outlet passage to an outlet for the coolant to pass back to the internal combustion engine on the first side, the main body having a fluid inlet to receive a fluid, pass the fluid in a heat exchange relationship with the coolant and output the fluid from the main body at a fluid outlet;

a manifold coupled to the main body on a second side, the manifold in fluid communication with the main coolant outlet passage to receive a portion of the coolant from the main body, and one or more outlet ports fluidly connected to the manifold and passing the portion of the coolant to one or more engine auxiliary systems.

2. The heat exchanger of claim 1, wherein the manifold is mounted to the second side adjacent the fluid inlet.

3. The heat exchanger of claim 1, wherein the fluid outlet is on the second side.

4. The heat exchanger of claim 1, wherein the one or more of outlet ports comprises two or more outlet ports to pass the portion of the coolant to two or more engine auxiliary systems, and wherein at least two of the two or more outlet ports have a different shape or size relative to one another.

5. The heat exchanger of claim 1, wherein the main body defines:

a first plurality of spaced apart passages extending from adjacent a third side of the heat exchanger to adjacent a fourth side thereof;

a main coolant inlet passage extends from the coolant inlet through the main body toward the second side and fluidly communicates with the first plurality of the passages;

wherein the main coolant outlet passage extends from the coolant outlet through the main body to the manifold and fluidly communicates with the first plurality of passages.

6. The heat exchanger of claim 5, wherein an end of the main coolant outlet passage is positioned opposite the outlet and the end has the portion of the coolant that fluidly communicates with the manifold.

7. The heat exchanger of claim 5, wherein the main body defines:

a second plurality of spaced apart passages extending from adjacent the third side of the heat exchanger to adjacent the fourth side thereof, wherein the second plurality of spaced apart passages are interposed between and spaced from the first plurality of spaced apart passages;

a main fluid inlet passage extends from the fluid inlet on a second side of the main body through the main body toward the first side and fluidly communicates with the second plurality of the passages, wherein the main fluid inlet passage is adjacent the main coolant outlet passage; and a main fluid outlet passage extends from the fluid outlet on the second side through the main body toward the first side and fluidly communicates with the second plurality of the passages, wherein the main fluid inlet passage is adjacent the main coolant outlet passage.

8. The heat exchanger of claim 1, w % herein the main body has a plurality of mounting flanges configured to mount the heat exchanger to the internal combustion engine, wherein one of the plurality of mounting flanges includes an aperture that forms the inlet to receive the coolant and second of the plurality of mounting brackets includes an aperture that forms the outlet for the coolant to return from the main body back to the internal combustion engine.

9. An internal combustion engine for a vehicle, the internal combustion engine comprising:

an internal combustion engine block;

one or more auxiliary systems of the internal combustion engine; and a heat exchanger coupled to the internal combustion engine block, the heat exchanger comprising:

a main body having an inlet to receive a coolant on a first side thereof and an outlet for the coolant to pass from the main body on the first side, the main body having a fluid inlet configured to receive fluid at a fluid inlet, pass the fluid in a heat exchange relationship with the coolant and output the fluid from the main body at a fluid outlet;

a manifold in fluid communication with the main body on a second side, the manifold receives a portion of the coolant from the main body; and one or more outlet ports fluidly connected to the manifold and fluidly connected to the one or more auxiliary systems of the internal combustion engine to pass the portion of the coolant to the one or more auxiliary systems of the internal combustion engine.

10. The internal combustion engine of claim 9, wherein the one or more auxiliary systems of the internal combustion engine are a diesel exhaust treatment system and a cab heating system.

11. The internal combustion engine of claim 9, wherein the main body defines:

a first plurality of spaced apart passages extending from adjacent a third side of the heat exchanger to adjacent a fourth side thereof;

a coolant inlet passage extends from the coolant inlet through the main body toward the second side and fluidly communicates with the first plurality of the passages, and a coolant outlet passage extends from the coolant outlet through the main body to the manifold and fluidly communicates with the first plurality of passages.

12. The internal combustion engine of claim 11, wherein an end of the coolant outlet passage is positioned opposite the outlet for the coolant fluidly communicates with the manifold.

13. The internal combustion engine of claim 11, wherein the main body defines:

a second plurality of spaced apart passages extending from adjacent the third side of the heat exchanger to adjacent the fourth side thereof, wherein the second plurality of spaced apart passages are interposed between and spaced from the first plurality of spaced apart passages;

a fluid inlet passage extends from the fluid inlet on a second side of the main body through the main body toward the first side and fluidly communicates with the second plurality of the passages, wherein the fluid inlet passage is adjacent the coolant outlet passage; and a fluid outlet passage extends from the fluid outlet on the second side through the main body toward the first side and fluidly communicates with the second plurality of the passages, wherein the fluid inlet passage is adjacent the coolant outlet passage.

14. The internal combustion engine of claim 9, wherein the main body has a plurality of mounting flanges that mount the heat exchanger to the internal combustion engine block, wherein one of the plurality of mounting flanges includes an aperture that defines the inlet to receive the coolant and second of the plurality of mounting flanges has an aperture that defines the outlet for the coolant back to the internal combustion engine.

15. A method of providing a coolant to one or more auxiliary systems of an internal combustion engine, the method comprising:

directing a fluid to a heat exchanger;

directing the coolant to the heat exchanger;

passing the coolant and the fluid through the heat exchanger to provide for heat exchange between the fluid and the coolant;

passing a first portion of the coolant to a manifold in fluid communication with the heat exchanger;

passing the first portion of the coolant from the manifold through one or more outlet ports to the one or more auxiliary systems of the internal combustion engine; and passing a remainder of the coolant and the fluid from the heat exchanger.

16. The method of claim 15, wherein passing the coolant from the manifold through the one or more outlet ports to the one or more auxiliary systems of the internal combustion engine passes the coolant to a diesel exhaust treatment system and a cab heating system.

17. The method of claim 15, wherein passing the remainder of the coolant from the heat exchanger passes the remainder of the coolant through one or more of a plurality of mounting flanges that mount the heat exchanger to the internal combustion engine.

18. The method of claim 15, wherein the one or more outlet ports comprises two or more outlet ports, wherein at least two of the two or more outlet ports have a different shape or size relative to one another.

19. The method of claim 15, wherein directing the coolant to the heat exchanger and passing the remainder of the coolant from the heat exchanger is from a first side of the heat exchanger and directing the fluid to the heat exchanger and passing the fluid from the heat exchanger is from a second side positioned opposite the first side of the heat exchanger.

20. The method of claim 15, wherein passing the coolant to the heat exchanger passes the coolant through one or more of a plurality of mounting flanges that mount the heat exchanger to the internal combustion engine.

* * * * *